US006655978B2

(12) United States Patent
Lutsch et al.

(10) Patent No.: US 6,655,978 B2
(45) Date of Patent: Dec. 2, 2003

(54) MALE CONNECTOR INCLUDING A CONNECTOR HOUSING, A SLIDE, AND A RETAINING ELEMENT

(75) Inventors: Harald Michael Lutsch, Weiterstadt (DE); Ranko Resman, Zagreb (DE); Dalibor Krivohlavec, Osijek (DE)

(73) Assignee: Yazaki Europe Ltd., Hemel Hempstead (GB)

( * ) Notice: Subject to any disclaimer, the term of this patent is extended or adjusted under 35 U.S.C. 154(b) by 0 days.

(21) Appl. No.: 10/193,267

(22) Filed: Jul. 12, 2002

(65) Prior Publication Data

US 2003/0022548 A1 Jan. 30, 2003

(30) Foreign Application Priority Data

Jul. 28, 2001 (DE) ..... 10136862

(51) Int. Cl.[7] ..... H01R 13/627; H01R 13/62
(52) U.S. Cl. ..... 439/352; 439/310
(58) Field of Search ..... 439/352, 353, 439/355, 357, 310

(56) References Cited

U.S. PATENT DOCUMENTS

| | | | | |
|---|---|---|---|---|
| 6,109,956 A | * | 8/2000 | Kawase et al. | 439/489 |
| 6,241,542 B1 | * | 6/2001 | Nishide et al. | 439/188 |
| 6,257,915 B1 | | 7/2001 | Endo | |
| 6,347,952 B1 | * | 2/2002 | Hasegawa et al. | 439/352 |
| 6,358,081 B1 | * | 3/2002 | Saka et al. | 439/352 |
| 6,383,009 B2 | * | 5/2002 | Kawase et al. | 439/352 |

FOREIGN PATENT DOCUMENTS

| | | |
|---|---|---|
| DE | 198 28 968 A1 | 12/1999 |
| DE | 100 52 970 A1 | 5/2001 |
| EP | 0 896 396 A2 | 2/1998 |
| EP | 1 089 393 A1 | 4/2001 |

* cited by examiner

*Primary Examiner*—Chandrika Prasad
(74) *Attorney, Agent, or Firm*—Sughrue Mion, PLLC

(57) ABSTRACT

The invention relates to a male connector (13) for being connected to a female connector (1) whose female connector housing (2), on the outer face (9) of same, comprises an engaging lug (10). The male connector (13) comprises a male connector housing (14) with a resilient locking arm (22) with engaging means (23) and with releasing faces (27) near the end of the locking arm (22) which is remote from the engaging means (23). The male connector (13) is associated with a slide (30) which is held on the male connector (13) so as to be axially displaceable relative thereto to a limited extent. In the locking position, the slide (30) prevents the locking arm (22) from being deflected and releases the locking arm (22) in a position deviating from the locking position. Pressure springs (37) which are supported on the male connector housing (14) and on the slide (30) load the slide (30) to enable same to assume its locking position. A resilient retaining element (38) made of steel is secured to the slide (30) and is provided with a retaining face (41) and a setting face (43). The retaining face (41), in the untensioned position of the spring arm (40), serves to establish contact with the end face (6) of the male connector housing (2). As a result of the setting faces (43) stopping against the releasing faces (27) of the male connector housing (14), the retaining face (41) is made to lose contact with the end face (6).

13 Claims, 7 Drawing Sheets

MALE CONNECTOR INCLUDING A CONNECTOR HOUSING, A SLIDE, AND A RETAINING ELEMENT

BACKGROUND OF THE INVENTION

The invention relates to a male connector having a terminal for being connected to a female connector having a terminal. The female connector includes a female connector housing with a first longitudinal axis and with a receiving chamber which is enclosed by a wall. The receiving chamber is open towards an end face of the female connector housing and, at the end remote from the open end face has a closed bottom. The female connector housing is associated with first terminals which project into the receiving chamber from the bottom so as to extend parallel to the first longitudinal axis. On the outer face of the wall enclosing the receiving chamber, there is projectingly arranged an engaging lug which comprises a stop face rising from the end face to the bottom so as to extend away from the outer face and which, towards the bottom, is provided with an engaging face extending towards the outer face.

EP 0 896 396 A2 describes a connecting assembly which comprises a female connector and a male connector. The female connector comprises a female connector housing and a receiving chamber enclosed by a wall. The receiving chamber opens to-wards an end face of the female connector housing and, at the end remote therefrom, is closed by a bottom. The female connector comprises a first longitudinal axis which defines a connecting direction. The female connector housing is associated with first terminals which are aligned so as to extend parallel to the first longitudinal axis and which project from the bottom into the receiving chamber. On the outer face of the wall enclosing the receiving chamber, there is projectingly arranged an engaging lug. The male connector is associated with a resiliently deflectable locking arm which can be locked by a slide when it is in the locking position, thus preventing a deflection of the locking arm from the untensioned position. The slide is associated with pressure springs which, at their ends not supported on the slide, are connected to one another by a cross arm. The locking arm comprises an inclined face which, while the male connector is inserted into the female connector, stops against the engaging lug, with the slide being in a position in which its locking face is not in contact with the locking arm. For this purpose, the locking arm is held by retaining means in a temporary position. When the male connector is inserted into the female connector, not only the locking arm with its hook-like projection stops against the engaging lug, but also the cross arm connecting the two pressure springs to one another comes to rest against the end face of the female connector. When the male connector is introduced further, the springs are pretensioned. The hook-like locking element of the locking arm slides over the engaging lug. At this stage, the locking arm has reached a position in which its locking face is able to engage behind the engaging lug. In the process, the effect of the pressure springs is also released, i.e. the retaining means release the slide, so that the latter, due to the effect of the springs, is displaced away from the engaging lug, as a result of which the locking face of the slide moves across the locking arm and se-cures same in its engaged position against being deflected. The retaining means, too, are returned into their original position, so that the load on the springs is also released. For releasing purposes, the slide has to be displaced in the direction opposed to the releasing direction of the male connector at the female connector, so that the locking arm is re-leased. To ensure a sufficiently large contact face for supporting the pressure springs, the female connector housing is provided with ribs which are arranged on the line of extension of the pressure springs, i.e. they extend parallel relative to one another in the connecting direction; they start from the end face of the female connector and extend as far as the engaging lug.

For releasing purposes, the slide is first displaced towards the female connector until the locking arm is released. The pressure springs are partially pretensioned and the retaining means secure the slide in said position. In this position, an unlocking portion of the slide can be acted upon, i.e. pressure can be exerted on same, as a result of which said portion acts on a locking arm projection positioned underneath. As the locking arm is suspended rocker-like, the hook-like projection is disengaged from the engaging lug at the female connector. If the male connector is now pulled, it can be separated from the female connector. This involves a complicated type of handling and especially in those cases where a safe mode of operation is required, there is a need for additional measures in the form of providing the ribs at the female connector in order to achieve secure support for the pressure springs which load the slide. Furthermore, handling is disadvantageous in that when releasing the male connector from the female connector, the slide first has to be moved against the releasing direction in order to transfer same into a position wherein, via the actuating portion associated with the slide, a force is applied to the locking arm in the sense of releasing same from the engaging lug of the female connector. At the same time, it is necessary to pull the male connector in order to release same from the female connector.

DE 198 28 968 A1 concerns a connector assembly having a female connector and a male connector, wherein the female connector is associated with a leaf-spring-like retaining element which, at the same time, serves as a short circuit bridge for the contacts of the female connector. The retaining element comprises two engaging arms which each come into contact with a projection of the male connector and, in the course of connection, undergo deformation, so that the projections are able to move across a kink in the engaging arm, thus permitting renewed resilience, so that the male connector is secured in the female connector. Furthermore, there are provided terminal arms which, in the unconnected condition of the male connector and female connector, are connected to the terminals of the female connector and form part of the retaining element which is produced from metal and is thus electrically conducting. In the unconnected condition, there thus occurs short-circuiting between the terminals via the terminal arms. When the male connector is inserted, said terminal arms are moved out of contact with the terminals of the female connector.

DE 100 52 970 A1 describes a connector assembly which comprises a female connector and a male connector, wherein the male connector is associated with a slide which is formed so as to be integral with a pressure spring and which, in the course of being connected, is first pretensioned and generates a sliding-out force for as long as the final state of connection has not yet been achieved. Furthermore, in the connected condition, the slide acts as a retaining element. The resilient portion provided in the form of a pressure spring comprises a leaf-spring-like portion which is bent like a snake.

EP 1 089 393 A1 concerns a female connector which is provided with a receiving chamber enclosed by a wall and into which a male connector can be inserted. To achieve a waterproof assembly, the male connector, on its portion entering the receiving chamber of the female connector, is provided with a seal which establishes contact with the inner face of the receiving chamber. The cross-section of the male connector portion entering the receiving chamber of the female connector is tapered as compared to the male connector portion which is set back relative thereto.

SUMMARY OF THE INVENTION

It is the object of the invention to provide a male connector for a standard female connector, i.e. a female connector comprising only one engaging lug. The male connector is easy to handle and, as long as the final connection has not yet taken place, generates a force which releases the male connector from the female connector.

The objective is achieved by providing a male connector comprising a male connector housing having a second longitudinal axis, which, with the second longitudinal axis extending parallel relative to the first longitudinal axis of the female connector, comprises a first housing portion insertable into the receiving chamber and having an end face from which there are accessible second terminals matching the first terminals and serving to be connected to same, the male connector housing further comprising a resiliently deflectable locking arm with engaging means, wherein the locking arm, by means of its end remote from the engaging means, is integrally connected to the first housing portion or to a intermediate housing portion formed so as to be integral with the first housing portion and, in the untensioned condition, extends parallel to the second longitudinal axis and wherein, in the transverse direction relative to the longitudinal axis, the locking arm is arranged at a distance from the first housing portion, with the engaging means of the locking arm, when being connected to the female connector housing, being positioned opposite the engaging lug, and which further comprises a releasing face which is positioned near the end of the locking arm remote from the engaging means and which away from the engaging means diverges from the second longitudinal axis, a slide which is held on the outside of the male connector housing so as to be adjustable to a limited extent along the second longitudinal axis, which, in the locked position, prevents the locking arm from being deflected from the untensioned condition and releases same in a position deviating therefrom, at least one pressure spring which, in parallel to the second longitudinal axis, is supported on the male connector housing on the one hand and on the slide on the other hand and loads the slide towards assuming its locking position, and a leaf-spring-like retaining element made of steel which is fixed to the slide by means of a fixing portion and, starting therefrom, comprises at least one spring arm which is resilient transversely to the second longitudinal axis and which comprises an adjoining retaining face and a setting face at its end remote from the fixing portion, with the retaining face serving to contact the end face of the female connector housing when the spring arm is in the untensioned condition, which retaining face can be moved out of contact with the end face by causing the setting face to move onto the releasing face of the male connector housing.

The advantage of this embodiment is that the male connector can be used in connection with standard female connectors comprising only one engaging lug, so that, without having to modify same, it is ensured that the male connector is separated from the female connector as long as the final locking position has not been reached. Furthermore, handling is simplified in that, in the course of the connecting procedure, only the male connector housing is acted upon in that it is moved relative to the female connector housing, i.e. towards the bottom of same. For finally securing the locking arm, the slide is released automatically as a function of the position of the male connector housing relative to the female connector housing in that the leaf-spring-like retaining element is disengaged from the end face of the female connector housing, as a result of which the force of the pressure springs effective between the male connector housing and the slide is released. The slide is displaced relative to the female connector housing and male connector housing in such a way that the locking arm is secured to prevent displacement into the unlocked position. Said position is easy to abolish in that, in order to release the male connector from the female connector, the slide has to be acted upon in the releasing direction only.

According to a further embodiment, it is proposed that the locking arm is frame-like having two longitudinal struts, that the retaining element is arranged between the two longitudinal struts of the locking arm and that the engaging means form part of a transversely extending engaging strut which connects the free ends of the longitudinal struts.

In order to ensure that the locking arm is positively released from engaging the engaging lug, it is proposed that the slide comprises at least one releasing projection which, in the sense of releasing the engaging means from the engaging lug, act on the locking arm when the female connector is released from the male connector by displacing the slide.

As, in the final locked condition between the male connector and the female connector, the steel retaining element is resiliently deflected from its normal position, i.e. as long as the female connector and male connector are connected to one another, said retaining element is tensioned, it is advantageous for the retaining element to consist of high-grade steel.

In a preferred embodiment, the fixing portion of the retaining element is bent to form a spring arm, in particular, it is bent to be u-shaped, and comprises an engaging arm. The retaining element, together with the fixing portion and the associated engaging arm, can be inserted into a retaining recess of the slide; it is laterally guided therein and to prevent same from being extracted, it is held by the engaging arm which, by means of its end face, is supported against a sup-porting face in the region of the recess of the slide. The free end of the spring arm forms a retaining face and a set-ting face. To achieve this, it is proposed that the free end of the spring arm, by being angled several times, forms the retaining face and the setting face. Alternatively, it is proposed that the free end of the spring arm, by means of a rolled-in portion, forms the retaining face and the setting face.

Furthermore, it is proposed that the first housing portion, towards the intermediate portion to which the locking arm is integrally connected, is provided with a seat portion for receiving a seal, which seat portion comprises a reduced cross-section.

BRIEF DESCRIPTION OF THE DRAWINGS

A preferred embodiment is diagrammatically illustrated in the drawing wherein.

DETAILED DESCRIPTION OF THE INVENTION

Figure 1:
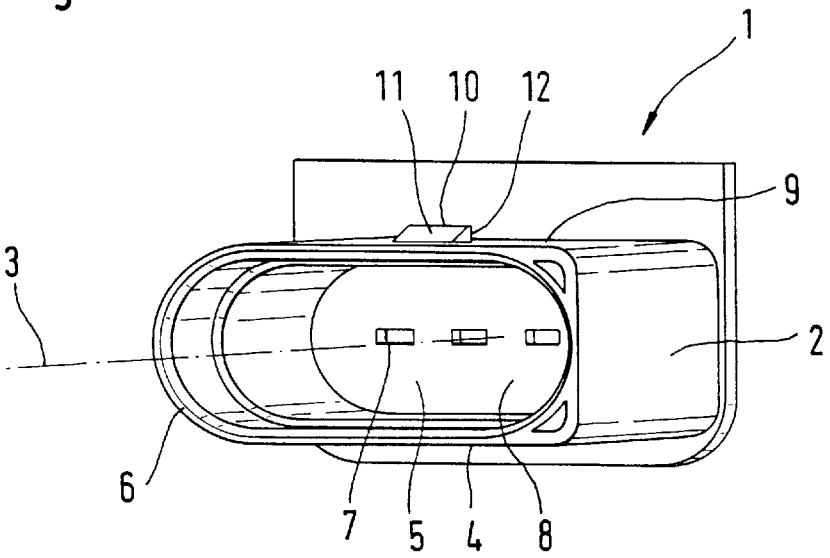
FIG. 1 is a perspective illustration of the female connector.

A standard female connector is shown in FIG. 1. The female connector 1 comprises a female connector housing 2 with a longitudinal axis 3. Furthermore, it comprises a wall 4 which encloses a receiving chamber 5 having an approximately rounded rectangular (i.e., oval) opening cross-section, as is shown in FIG. 1. The receiving chamber 5 is open towards the end face 6 and at the end opposite thereto it is closed by a bottom 8. From the bottom 8, there project first connecting terminals 7 in the form of pins. They extend parallel to the first longitudinal axis 3. On the outer face 9 of the wall 4, there is arranged an engaging lug 10 which, towards the end face 6, comprises an inclined stop face 11 which rises from its end facing the end face 6 towards the bottom 8 while extending away from the outer face 9. Said stop face 11 is followed by an engaging face 12 which extends towards the outer face 9, i.e. it preferably extends perpendicularly relative thereto and, optionally, even comprises an undercut.

Figure 2:
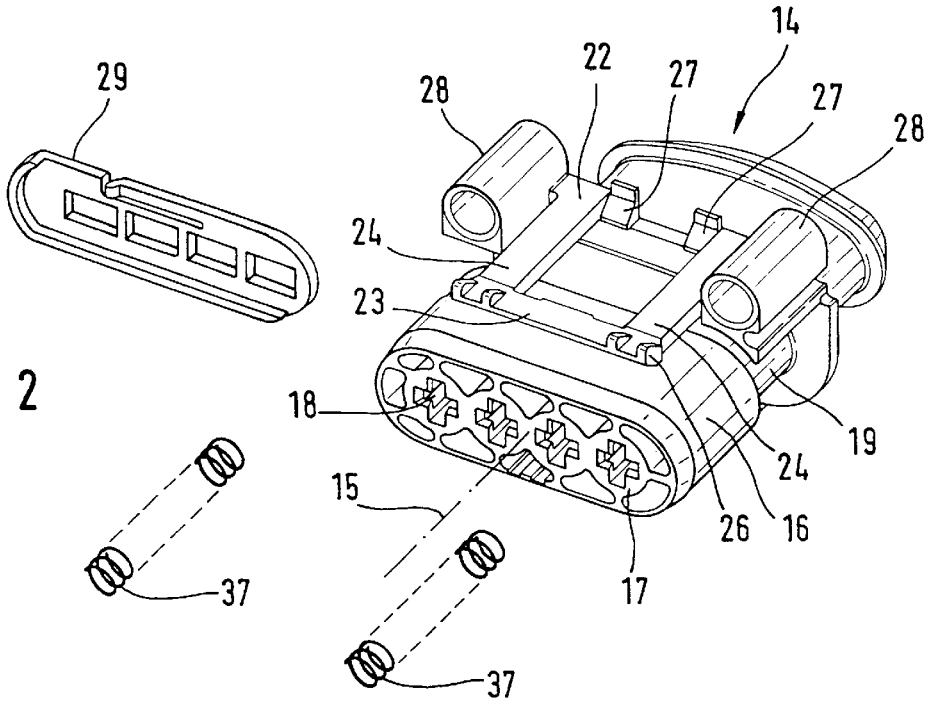
FIG. 2 is a perspective illustration of the male connector housing, including a view of the locking arm and of the pressure springs as well as of the locking element.
Figure 3:
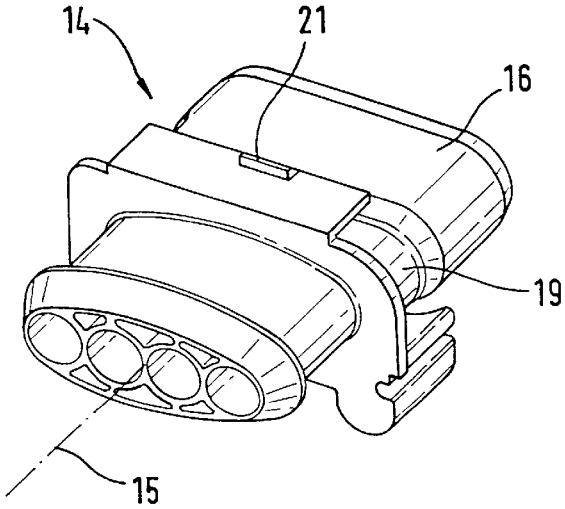
FIG. 3 is a perspective illustration of the male connector housing, including a view of the male connector side facing away from the locking arm.

FIGS. 2 and 3 show the male connector housing 14 of the male connector 13 (see FIGS. 7–11). The male connector housing 14 has the second longitudinal axis 15. It comprises a first housing portion 16 which, when being connected to the female connector 1, enters the receiving chamber 5 according to FIG. 1. The first longitudinal axis 3 and the second longitudinal axis 15 are in alignment. The first housing portion 16 starts from an end face 17 in which there are provided openings which are connected to terminal receiving chambers in which there are received second terminals 18 in the form of bush-like terminals which are secured by a locking element 29.

The first housing portion 16 is followed by an intermediate portion 19, with a seat portion with a reduced cross-section for a seal 20 (see FIG. 7) being arranged therebetween. The cross-section of the first housing portion 16 is adapted substantially to that of the receiving chamber of the female connector housing, i.e. it comes close to a rounded rectangular (i.e., oval). On one wide face of said member, there is arranged a locking arm 22 which is frame-like and comprises two longitudinal struts 24 which are arranged in parallel and at a distance from one another and which, by means of one end at the intermediate portion 19, remote from the end face 17, are formed so as to be integral with the male connector housing 14. The ends of the two longitudinal struts 24, which are close to the end face 17, are connected to one another by a transversely extending engaging strut 23 which serves as an engaging element for engaging the engaging lug 10 of the female connector 1.

In the region of the ends of the longitudinal struts 24, which are close to the engaging strut 23, there are provided locking projections 26. In the region opposed thereto, there are arranged releasing faces 27 which adjoin the longitudinal struts 24 and which extend away from the end face 17 and from the second longitudinal axis 15. Furthermore, said region is provided with two first spring supporting bearings 28 which extend to one side of the longitudinal struts 24 of the locking arm 22 and which serve to support the pressure springs 37 at one end. On its underside, the engaging strut 23 comprises a setting face 25 which extends away from the first spring supporting bearings 28 and away from the second longitudinal axis 15 (see FIG. 7). The locking element 29 additionally shown in FIG. 2 which can be inserted transversely into the housing portion, away from the end face 17, (see also FIG. 7), serves to prevent the second terminals 18 received in the first housing portion 16 from being extracted. As can be seen in FIG. 3, the face of the male connector housing 14 facing away from the locking arm 22 is provided with an arm with a hook-shaped stop 21.

Figure 4:
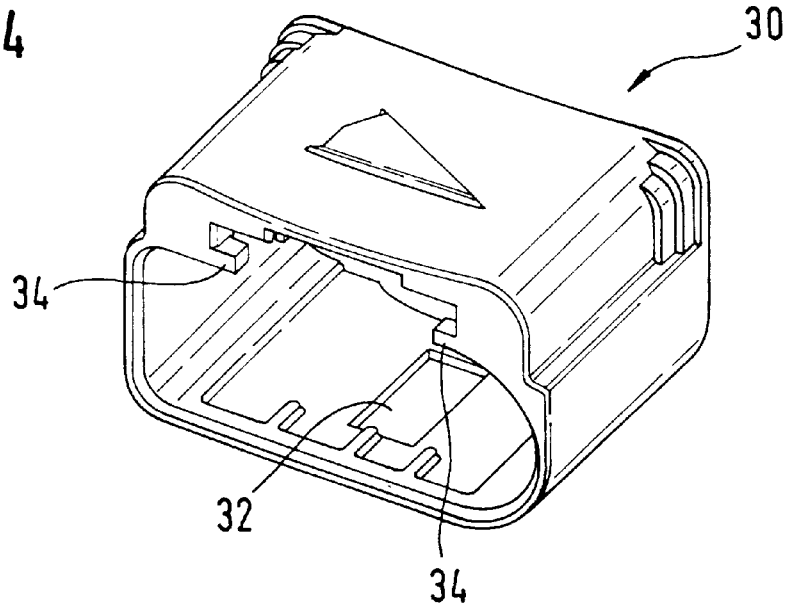
FIG. 4 is a first perspective illustration of the slide.
Figure 5:
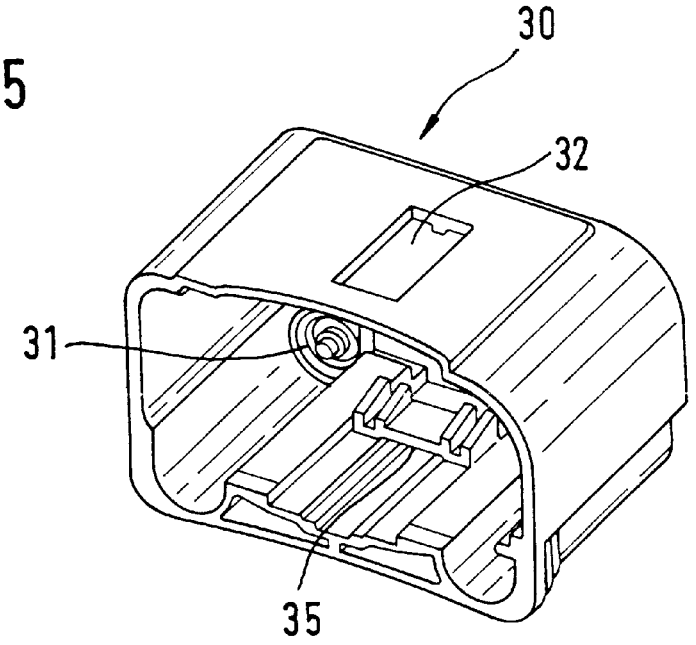
FIG. 5 is a second perspective illustration of the slide.

The structure of the slide 30 is shown in FIGS. 4 and 5. It can be seen that the slide 30 is tubular in shape, and in its interior, towards an end face, it comprises two spring supporting bearings 31 which support the other ends of the pressure springs 37. The face positioned opposite the second spring supporting bearings 31 is provided with a setting recess 32 which cooperates with the stop 21 when the slide 30 is fitted in the male connector housing 14. Furthermore, FIG. 7 shows locking abutments 33 which, when the female connector 1 is finally connected to the male connector 13, secure the locking arm 22 at the female connector housing 2 against being displaced, i.e. they cooperate with the locking projections 26.

At its end comprising the second spring supporting bearings 31, the slide 30 is associated with two releasing projections 34 which serve to release the locking arm 22 when the male connector 13 is in the process of being released from the female connector 1. When the slide is pulled in the releasing direction, said locking arm 22 is moved so as to be released from the engaging projection of the female connector before the male connector housing can be withdrawn from the female connector housing. Furthermore, the slide comprises a retaining recess 35 with a supporting face 36 (see FIG. 7).

Figure 6:
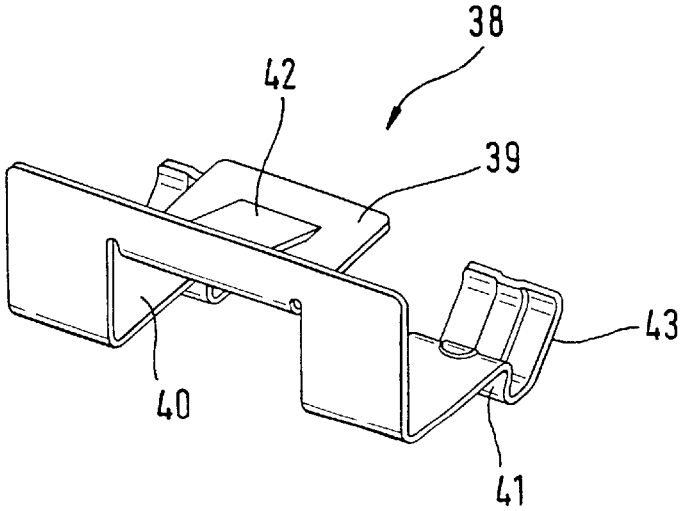
FIG. 6 is a perspective illustration of the leaf-spring-like retaining element.

FIG. 6 shows a retaining element 38 which is made of high-grade steel, which is leaf-spring-like and angled several times, so that the spring arm 40 and, respectively, the two spring arms 40, together with the fixing portion 39, form a u-shape, with the fixing portion 39 being associated with an engaging arm 42 which is punched out of same and serves to prevent extraction in a retaining recess 35 of the slide 30 in accordance with FIGS. 4 and 5. A portion forming the retaining face 41 is angled relative to, and connected to, the spring arms 40 which, in turn, are followed by two substantially inclined or curved portions each having a setting face 43.

Figure 7:
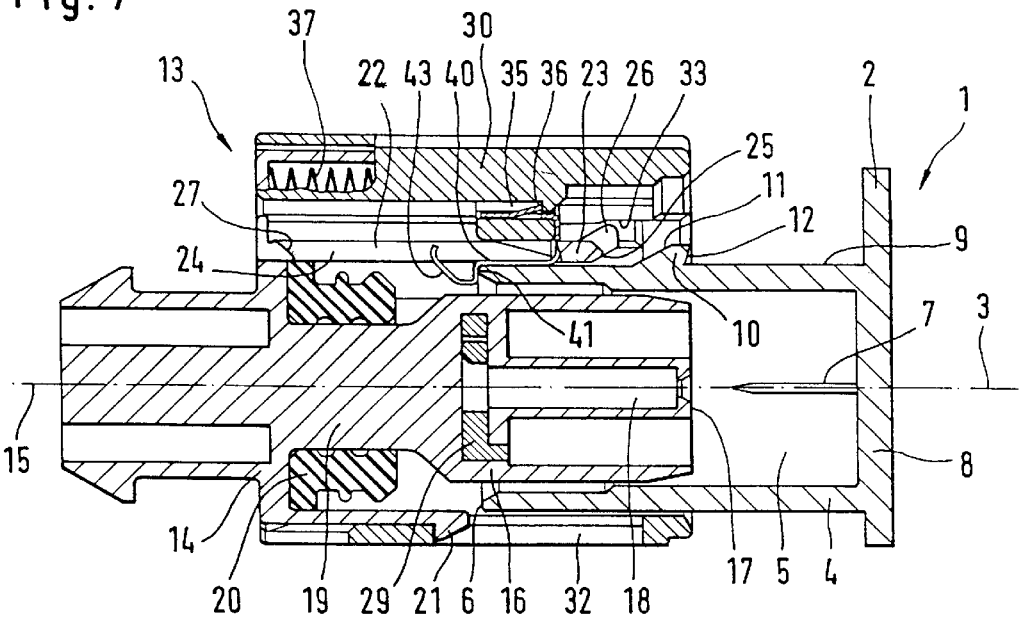
FIG. 7 shows the relative positions of the male connector and female connector in their initial state of connection.
Figure 8:
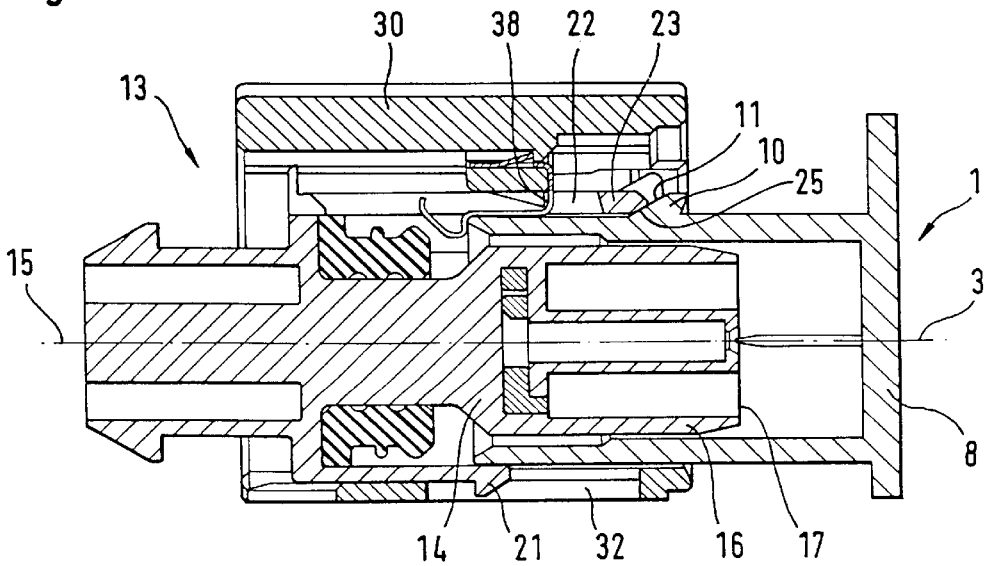
FIG. 8 shows a state of connection which is more advanced as compared to FIG. 7 and wherein the engaging means of the locking arm of the male connector have reached the position where they contact the engaging lug of the female connector.

FIG. 7 shows the initial state of connection between the female connector 1 and the male connector 13. It can be seen that the slide 30 is fitted to the male connector housing 14. The slide 30 encloses the male connector housing 14. A movement parallel to the second longitudinal axis 15 is delimited by the stop 21 engaging the setting recess 32. The springs 37 load said stop 21 to enable same to assume its position relative to the male connector housing 14 as shown in FIG. 7, with an end face close to the end face 17 of the first housing portion approximately finishing with the end face 17.

It can be seen that the first housing portion 16 has already been partially introduced into the receiving chamber 5 of the female connector housing 2. The end face 17, however, is clearly positioned before the ends of the first male terminals 7. The first longitudinal axis 3 and the second longitudinal axis 15 are, however, aligned relative to one another. It is also possible to see the fitted seal 20.

Furthermore, FIG. 7 shows the way in which the retaining element 38 with the fixing portion 39 is arranged in the retaining recess 35 of the slide 30, with the engaging arm 42, by means of its end face, being supported against the supporting face 36 of the retaining recess 35. By means of its retaining face 41, the retaining element 38 rests against the end face 6 of the female connector 1. The spring arms 40 are in the untensioned condition. The locking arm 22, together with the engaging strut 23, is still close to the outer face 9 of the wall 4 of the female connector 1, which wall 4 delimits the receiving chamber 5, and is secured against being deflected out of the position transversely to the second longitudinal axis 15 by the locking abutments 33 positioned so as to oppose the locking projections 26.

If the male connector housing 14 is now acted upon in the direction of insertion, i.e. in the connecting direction, so that the first housing portion 16 enters the receiving chamber 5 more deeply, i.e. by means of its end face 17 moves even closer to the bottom 8, the slide 30, due to the retaining face 41 of the retaining element 40, resting against the end face 6 of the female connector 1, remains in a stationary position relative to the female connector 1, i.e. it stays behind relative to the male connector housing 14. It can be seen in FIG. 8 that the male connector housing 14, by means of its end face 17, has further approached the bottom 8 of the female connector 1, so that the setting face 25 of the engaging strut 23 of the locking arm 22 is already in contact with the stop face 11 of the engaging lug 10. The end face of the slide 30, which faces the female connector 1, is no longer in one plane with the end face 17 of the housing portion 16, but is already positioned close to the engaging strut 23.

Figure 9:
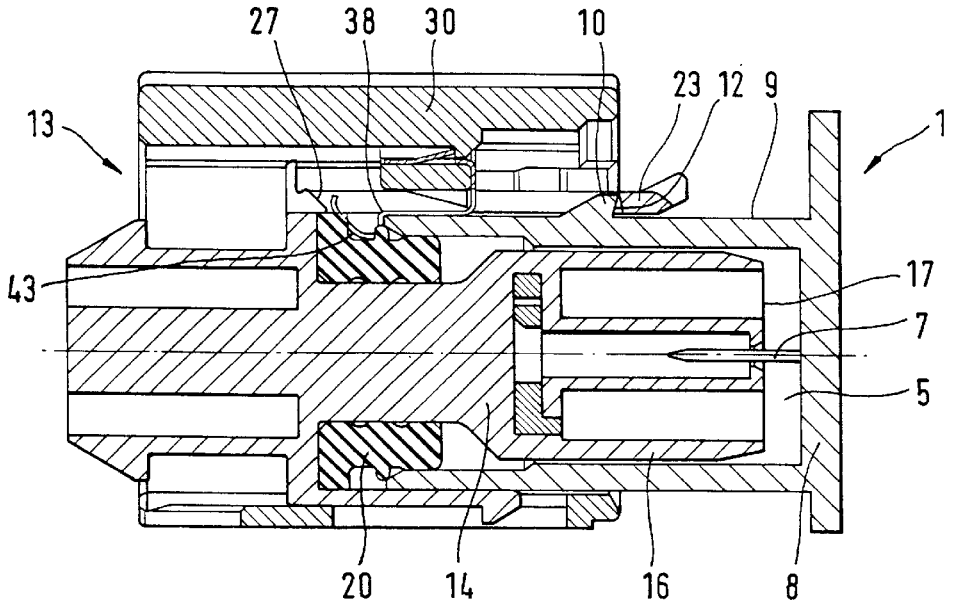
FIG. 9 shows an even more advanced position wherein the engaging means of the locking arm have passed the engaging lug of the female connector.

This condition continues until the position according to FIG. 9 has been reached in which the engaging strut 23 has passed the engaging lug 10 and, away from the bottom 8, is supported on the face 12 of the engaging lug 10, so that the engaging strut 23 is positioned in front of the adjoining end face of the slide 30. This movement causes the first terminal 7 to be introduced more deeply into the housing portion 16 of the male connector housing 14. The seal 20, too, is already partially in the receiving chamber 5 of the female connector housing 2 in order to achieve a sealing effect.

Figure 10:
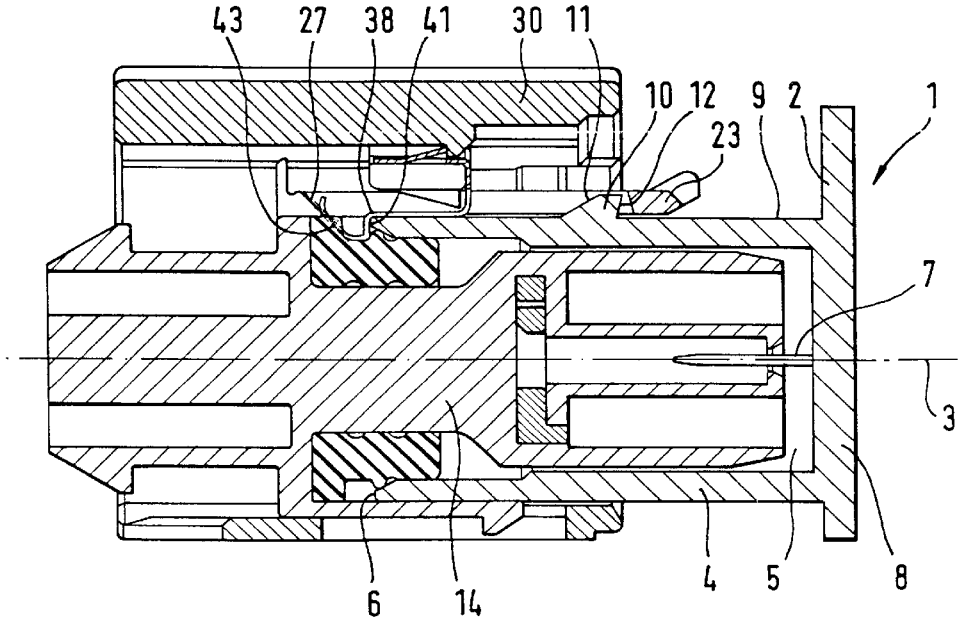
FIG. 10 shows a further connecting position at the start of the release of the holding means by the releasing face at the male connector housing.
Figure 11:
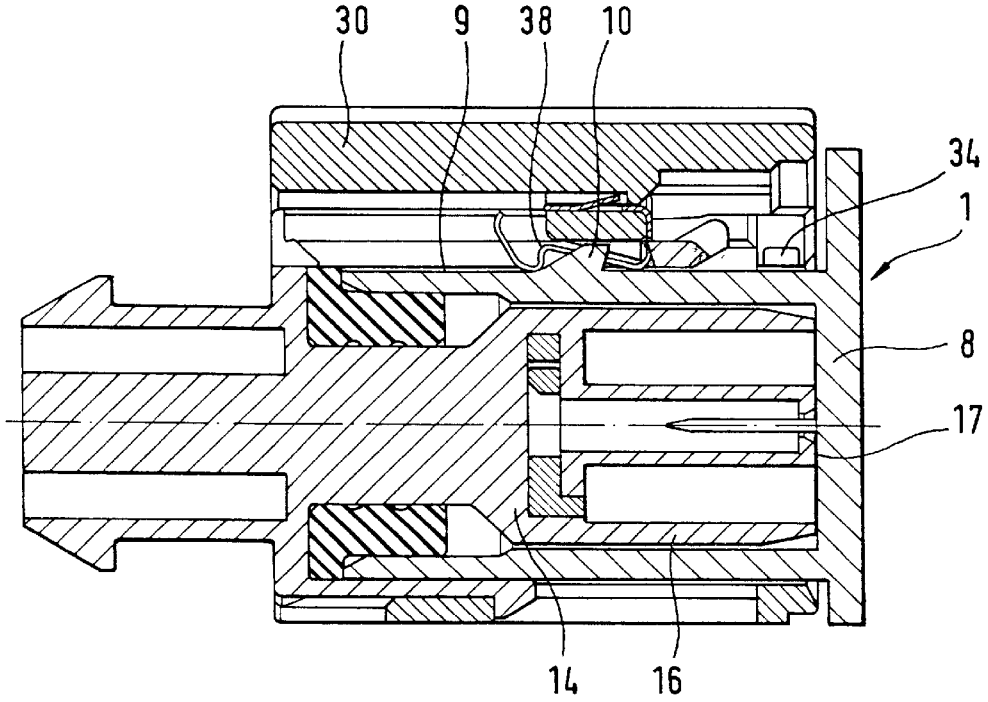
FIG. 11 shows the final locking position in which the locking arm is secured by the slide in the locked position to pre-vent any deflection.

Furthermore, the releasing face 27 of the male connector housing 14 has approached the setting face 43 of the retaining element 38, so that, as the male connector housing 14 is further inserted into the receiving chamber 5 and as the end face 17 approaches the bottom 8 of the female connector 1, the retaining element 38 reaches the position of contact as illustrated in FIG. 10, and as the retaining element 38 is inserted further, it is deflected, so that its retaining face 41 loses its contact with the end face 6 of the female connector 1, so that the pressure springs 37 which were pretensioned while the male connector housing 14 was introduced into the female connector 1 become effective, with the slide 30 being adjusted relative to the male connector housing 14 towards the bottom 8, with the retaining element 38 sliding on the outer face 9 of the female connector 1. In this position, the pressure springs 37 are untensioned and the slide 30, relative to the male connector housing 14, assumes the position as shown in FIG. 7, in which position the locking arm 22 is secured against being displaced away from the second longitudinal axis 15.

For releasing the male connector 13 comprising the male connector housing 14 and the slide 30 as well as the retaining element 38 and the seal 20 from the female connector 1, the slide 30 is acted upon in the releasing direction, i.e. in the direction opposite to the connecting direction, so that the slide 30 is moved away from the bottom 8. On the way back from the position according to FIG. 9, the releasing projections 34 act on the longitudinal struts 24 and lift up the locking arm 22, so that the engaging strut 23 becomes disengaged from the engaging lug 10. If one continues to act on the slide 30 by pulling same against the connecting direction, i.e. away from the bottom 8, the male connector housing 14 is released from the female connector 1.

Figure 12:
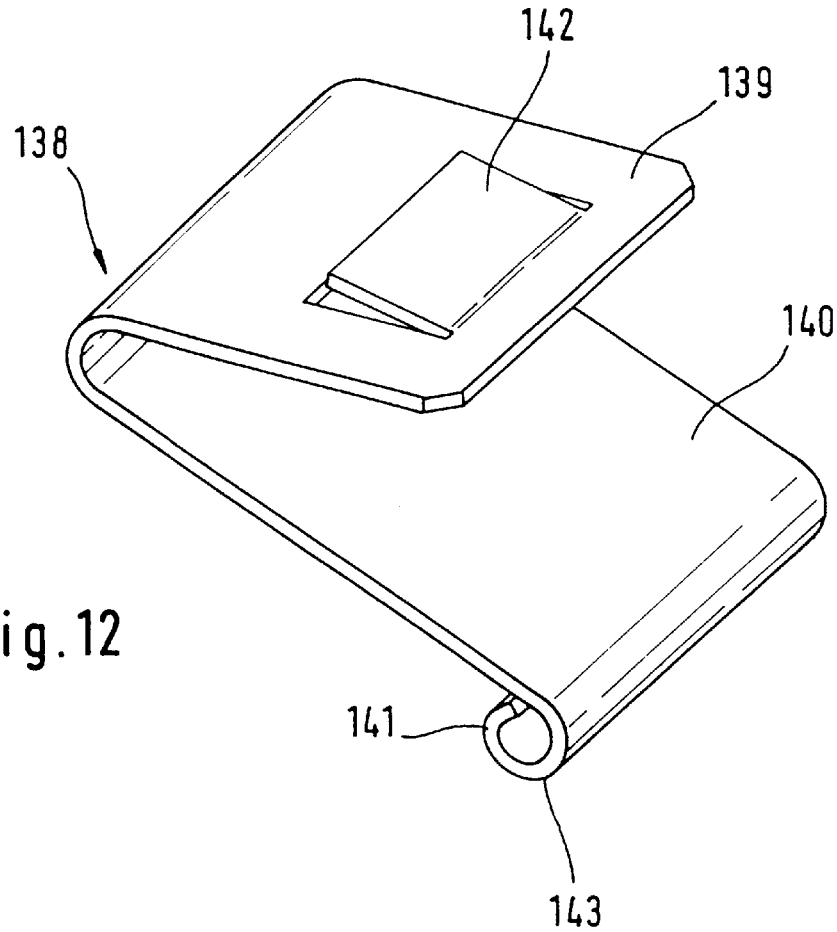
FIG. 12 shows an alternative embodiment of the retaining element in a perspective illustration.
Figure 13:
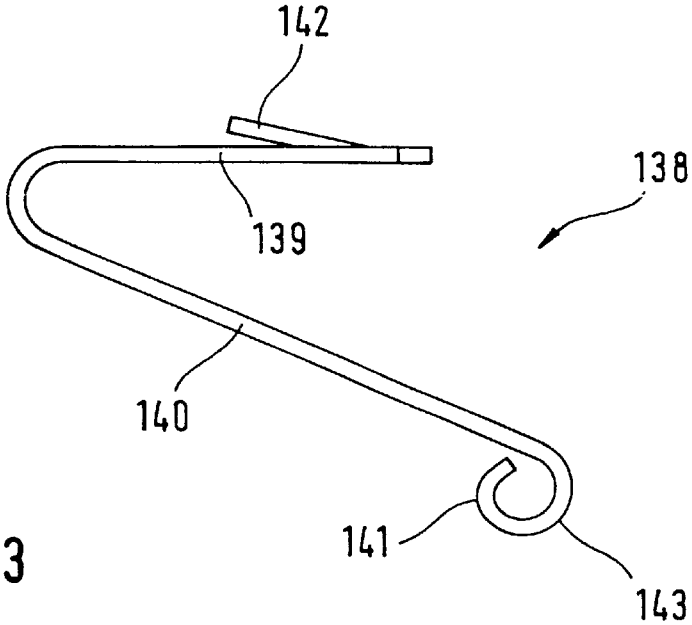
FIG. 13 is a side view of the retaining element according to FIG. 12.

FIGS. 12 and 13 show a perspective view and, respectively, a side view of an alternative embodiment of the retaining element 138 as compared to the retaining element 38 according to FIG. 6. The retaining element 138 is also made of high-grade steel. It also comprises a fixing portion 139 with an engaging arm 142 which is punched out and angled relative to the fixing portion 139 and which is to be fixed in the recess 35 of the slide 30. However, it comprises only one single continuous spring arm 140 which is thus stiffer than that of the retaining element 38. At the free end of the spring arm 140, there is provided a rolled-in portion which forms the retaining face 141 and simultaneously the setting face 143 which is circumferentially offset.

What is claimed is:

1. A male connector for being connected to a female connector, the female connector including a female connector housing having a first longitudinal axis and a receiving chamber, wherein the receiving chamber is enclosed by a wall and a bottom, and is open towards an end face of the female connector housing, first terminals that project into the receiving chamber from the bottom, which extend parallel to the first longitudinal axis, an engaging lug, projectingly arranged on an outer face of the wall, including a stop face provided on the outer face, wherein the stop face rises from a first position on the outer face toward a second position closer to the bottom than the first position so as to extend away from the outer face, and an engaging face that extends towards the outer face, the male connector comprising:

a male connector housing, including a second longitudinal axis extending parallel to the first longitudinal axis, a first housing portion insertable into the receiving chamber and having an end face, from which second terminals are accessible, wherein the second terminals are electrically connected to the first terminals when the first housing portion is inserted into the receiving chamber, a resiliently deflectable locking arm with engaging means, wherein the locking arm, at an end that is remote from the engaging means, is integral with the male connector housing, wherein the locking arm extends parallel to the second longitudinal axis, wherein, in the transverse direction relative to the longitudinal axis, the locking arm is arranged at a distance from the first housing portion, and wherein the engaging means of the locking arm is positioned opposite the engaging lug when the male connector housing is connected to the female connector housing, and a releasing face which is positioned near the end of the locking arm remote from the engaging means and which diverges away from the second longitudinal axis as the releasing face extends away from the position of the engaging means, a slide which is held on the outside of the male connector housing so as to be adjustable to a limited extent along the second longitudinal axis, wherein when the slide is in a locked position, the slide prevents the locking arm from being deflected, and wherein the slide releases the locking arm in a position deviating from the locked position, at least one pressure spring, which is parallel to the second longitudinal axis is supported between the male connector housing and the slide, and loads the slide towards the locked position, and a leaf-spring-like retaining element, including a fixing portion that is fixed to the slide, and at least one spring arm which is resilient transversely to the second longitudinal axis, and which has an adjoining retaining face and a setting face at its end remote from the fixing portion, wherein when the spring arm is in an untensioned condition, the retaining face contacts the end face of the female connector housing, and wherein the retaining face can be moved out of contact with the end face by causing the setting face to move onto the releasing face of the male connector housing.

2. The male connector according to claim 1, characterized in that the locking arm is frame-like and includes two longitudinal struts, that the retaining element is arranged between the two longitudinal struts of the locking arm, and that the engaging means form part of a transversely extending engaging strut, which connects the free ends of the longitudinal struts.

3. The male connector according to claim 1, characterized in that the slide includes at least one releasing projection which, when the slide is displaced from the locked position, acts on the locking arm so that the engaging means is released from the engaging lug, and the female connector is released from the male connector.

4. The male connector according to claim 1, characterized in that the retaining element is made of high-grade steel.

5. The male connector according to claim 1, characterized in that the fixing portion of the retaining element is bent to form the spring arm, that the fixing portion includes an engaging arm, that the fixing portion is received in a retaining recess of the slide and is supported against a supporting face of the slide by the end face of the engaging arm.

6. The male connector according to claim 1, characterized in that the locking arm is integrally connected to the intermediate housing portion of the male connector housing, that an intermediate housing portion is provided with a seat portion for receiving a seal, and that the seat portion has a reduced cross-section.

7. The male connector according to claim 5, characterized in that a free end of the spring arm forms the retaining face and the setting face.

8. The male connector according to claim 7, characterized in that, the free end of the spring arm and forms the retaining face and the setting face.

9. The male connector according to claim 7, characterized in that the free end of the spring arm is a rolled-in portion, and forms the retaining face and the setting face.

10. The male connector according to claim 2, characterized in that the locking arm is integrally connected to an intermediate housing portion of the male connector housing, the intermediate housing portion is provided with a seat portion for receiving a seal, and that the seat portion comprises a reduced cross-section.

11. The male connector according to claim 3, characterized in that the locking arm is integrally connected to an intermediate housing portion of the male connector housing, the intermediate housing portion is provided with a seat portion for receiving a seal, and that the seat portion comprises a reduced cross-section.

12. The male connector according to claim 4, characterized in that the locking arm is integrally connected to an intermediate housing portion of the male connector housing, that the intermediate housing portion is provided with a seat portion for receiving a seal, and that the seat portion comprises a reduced cross-section.

13. The male connector according to claim 5, characterized in that the locking arm is integrally connected to an intermediate housing portion of the male connector housing, that the intermediate housing portion is provided with a seat portion for receiving a seal, and that the seat portion comprises a reduced cross-section.

* * * * *

UNITED STATES PATENT AND TRADEMARK OFFICE

CERTIFICATE OF CORRECTION

PATENT NO. : 6,655,978 B2 
DATED : December 2, 2003
INVENTOR(S) : Harald Michael Lutsch, Ranko Resman and Dalibor Krivohlavek It is certified that error appears in the above-identified patent and that said Letters Patent is hereby corrected as shown below:

Title page,
Item [30], Foreign Application Priority Data, change "10136862" to -- 10136862.3 --.

Column 1,
Line 27, change "to-wards" to -- towards --.
Line 61, change "se-cures" to -- secures --.
Line 67, change "re-leased" to -- released --.

Column 4,
Line 51, change "sup-porting" to -- supporting --.
Line 53, change "set-ting" to -- setting --.

Column 5,
Line 30, change "pre-vent" to -- prevent --.
Line 45, change "project" to -- projects --.

Column 10,
Line 16, change "the" to -- an --.

Signed and Sealed this

Twentieth Day of July, 2004

JON W. DUDAS
*Acting Director of the United States Patent and Trademark Office*